US006014115A

United States Patent [19]

Ghaby et al.

[11] Patent Number: 6,014,115

[45] Date of Patent: Jan. 11, 2000

[54] LIGHT WEIGHT PARALLEL-PLATE POLARIZER IMPLANTATION FOR SPACE APPLICATIONS

[75] Inventors: Ramzi A. Ghaby, Redondo Beach; John J. Hilgendorf, Chino; Chun-Hong H. Chen, Torrance, all of Calif.

[73] Assignee: TRW Inc., Redondo Beach, Calif.

[21] Appl. No.: 08/992,309

[22] Filed: Dec. 17, 1997

[51] Int. Cl.[7] ..... H01Q 15/24

[52] U.S. Cl. ..... 343/909; 343/756; 343/872; 343/897

[58] Field of Search ..... 343/756, 909, 343/897, 872, 700 MS, 783, 784, 912, DIG. 1; H01Q 15/24

[56] References Cited

U.S. PATENT DOCUMENTS

| | | | |
|---|---|---|---|
| 3,998,173 | 12/1976 | Williamson et al. | 343/897 |
| 4,652,886 | 3/1987 | Rosser et al. | 343/756 |
| 5,258,768 | 11/1993 | Smith | 343/786 |
| 5,528,249 | 6/1996 | Gafford et al. | 343/909 |
| 5,563,616 | 10/1996 | Dempsey et al. | 343/753 |
| 5,668,660 | 9/1997 | Hunt | 359/380 |

*Primary Examiner*—Don Wong
*Assistant Examiner*—Tho Phan
*Attorney, Agent, or Firm*—Michael S. Yatsko

[57] ABSTRACT

A light weight parallel plate polarizer (100) employs a sandwich construction design including a polarizer section (102) and a foundation section (104). The polarizer section (102) is formed from low dielectric constant, low density foam or honeycomb layers (112) alternating with polarizer panels (110). The foundation section (104), which supports the polarizer section (102), is formed from a low density, low dielectric constant foundation material. In an alternate embodiment of the present invention, the light weight parallel plate polarizer employs a suspension design (400). The suspension design (400) includes individual sections of dielectric mesh (602) which support polarizer plates (402). The individual mesh sections (602) are suspended between first and second support posts (404, 406) and compression springs (410) may be provided for adjusting and maintaining the tension in the mesh sections (602).

20 Claims, 3 Drawing Sheets

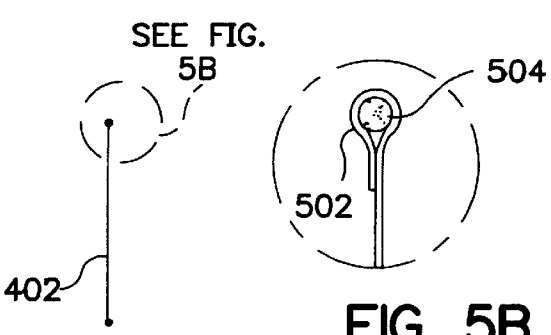
FIG. 5A
FIG. 5B
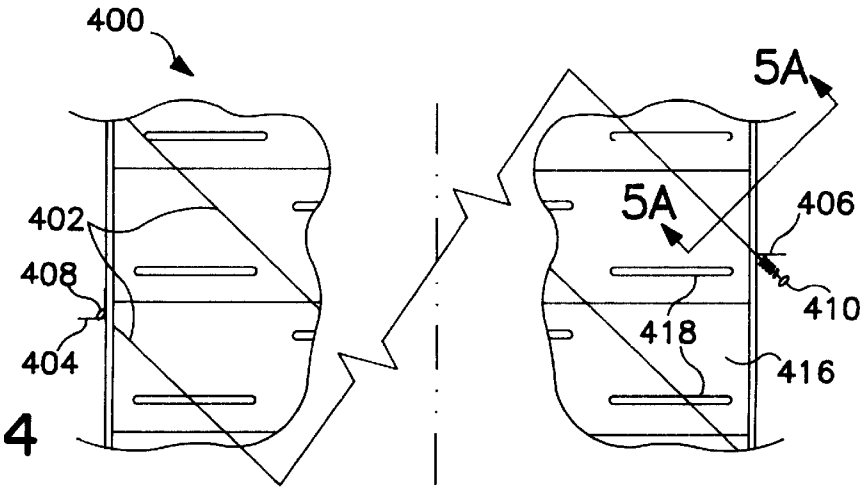
FIG. 4
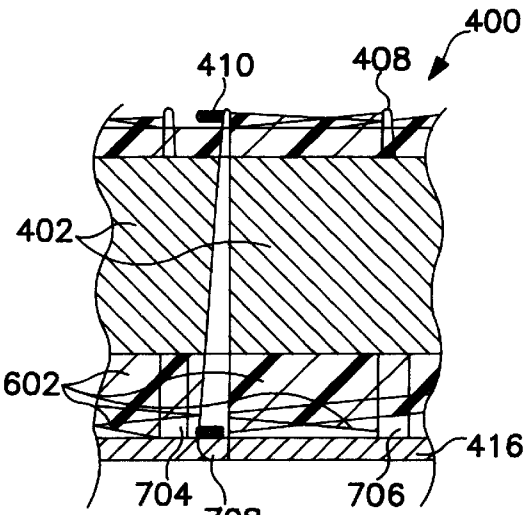
FIG. 7
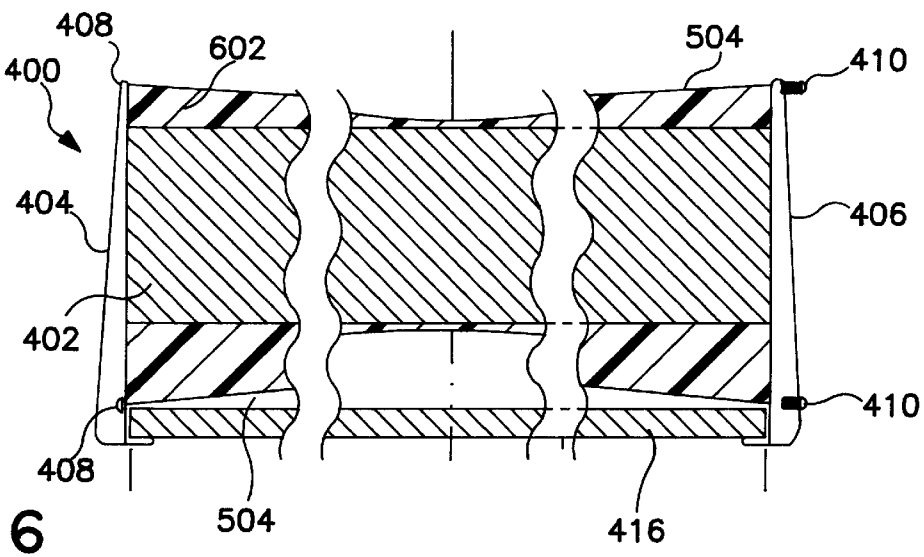
FIG. 6

LIGHT WEIGHT PARALLEL-PLATE POLARIZER IMPLANTATION FOR SPACE APPLICATIONS

BACKGROUND OF THE INVENTION

The present invention relates to polarizers for satellite antenna systems. More specifically, the invention relates to light weight parallel plate polarizers for satellite antenna systems.

Modern communications networks carry immense amounts of information, typically divided for transmission purposes into individual data channels. Whether the data channels carried by the communications network have their origin in the telephone system, television stations, or other source, these data channels often need to be transmitted through a communications network including a satellite link.

A satellite link in a communications network typically carries multiple antennas capable of transmitting wide bandwidth transmitted beams. Each transmitted beam, for example, may be assigned to a particular frequency band in order to reduce co-channel and adjacent channel interference (collectively "interference") which may limit the total bandwidth capacity of each transmitted beam.

Co-channel interference is interference generated in a transmitted beam assigned to a particular frequency band by nearby transmitted beams assigned to the same frequency bands. Co-channel interference occurs even though spot beams assigned to a particular frequency band are physically separated. In part, the amount of co-channel interference depends on the number of nearby spot beams covering the same frequency band.

Adjacent channel interference is interference generated in a spot beam assigned to a particular frequency band by neighboring spot beams of other frequencies. One common cause of adjacent channel interference is imperfections in the antennas used to generate the spot beams. Because virtually all antennas generate frequency sidelobes, the spot beams are not perfectly confined to their assigned frequency bands. As a result, spot beams may spill over in frequency into neighboring spot beams and cause adjacent channel interference.

In the past, satellites have used polarizers on their antennas to help reduce the effects of interference. Polarizers are typically mounted over the output section of an antenna, for example, over a slotted array waveguide. The transmitted beams generated by the antenna then pass into the polarizer where they are polarized in different planes. Because transmitted beams which are polarized in different planes, even though they occupy the same frequency band, may transmitted substantially free from interference, a receiver may separate the transmitted beams using a corresponding polarized antenna. In the past, however, polarizers for satellite antenna have been heavy, bulky, and structurally complex devices.

A need has long existed in the industry for light weight parallel plate polarizers suitable for use with satellite antennas.

BRIEF SUMMARY OF THE INVENTION

It is an object of the present invention to provide a light weight parallel plate polarizer.

It is another object of the present invention is to provide a light weight parallel plate polarizer that does not significantly attenuate transmitted or received signals at the antenna.

Yet another object of the present invention is to provide a light weight parallel plate polarizer using a suspension design to support the polarizer plates.

Another object of the present invention is to provide a light weight parallel plate polarizer using a sandwich design of polarizer plates and spacer material.

In one embodiment of the present invention, the light weight parallel plate polarizer employs a sandwich construction design including a polarizer section and a foundation section. The polarizer section is formed from low dielectric constant, low density foam layers alternating with polarizer panels. The foundation section, which supports the polarizer section, is formed from a low density, low dielectric constant foundation material.

The foundation section may be of honeycomb pattern material. The polarizer panels may be formed as metallic layers deposited on the foam layers. The polarizer section therefore uses low dielectric constant, low density foam layers sandwiched between polarizer panels. The polarizer section and the foundation section form a polarizer assembly which may be mounted, for example, on top of a slotted array waveguide section of an antenna.

In an alternate embodiment of the present invention, the light weight parallel plate polarizer employs a suspension design. The suspension design includes individual sections of dielectric mesh which support polarizer plates. The individual mesh sections are suspended between first and second support posts and compression springs may be provided for adjusting and maintaining the tension in the mesh sections.

The mesh sections are used to support the polarizer plates. Each polarizer plate, may, for example, be bonded to a corresponding mesh section. The polarizer plates may be constructed from a Polymide base coated with a conductive layer.

BRIEF DESCRIPTION OF THE SEVERAL VIEWS OF THE DRAWING

FIG. 4 illustrates a top view of a suspension design of a polarizer assembly.

FIG. 5 shows one implementation of a support structure for a polarizer plate used in the polarizer assembly of FIG. 4.

FIG. 6 shows an end view of the polarizer assembly of FIG. 4.

FIG. 7 shows a side view of the polarizer assembly of FIG. 4.

DETAILED DESCRIPTION OF THE INVENTION

Figure 1:
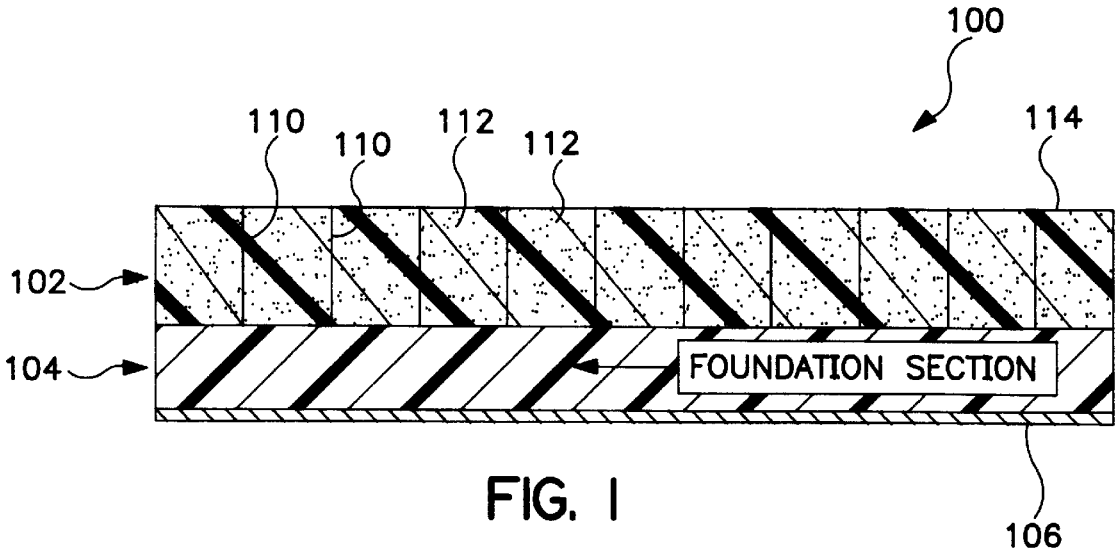
FIG. 1 illustrates a cross section of a sandwich design of a light weight parallel plate polarizer.

Turning now to FIG. 1, a cross section of a sandwich design of a light weight parallel plate polarizer assembly 100 is shown. The polarizer assembly 100 includes a polarizer section 102 and a foundation section 104. The polarizer assembly 100 is shown in place on top of a slotted array panel 106. The slotted array panel 106 may be included, for example, as part of an antenna structure (not shown) that generates transmitted beams.

The foundation section 104 may be formed from a low dielectric constant, low density foundation material. For example, Emerson ECCO PS, 6-2-4 foam (which has a density of 1.06 lb/ft$^3$, a loss tangent of 0.0002, and a dielectric constant of 1.02) may be used to form the foundation section 104. Furthermore, in a preferred embodiment of the polarizer assembly 100, the foundation section 104 may be filled with a honeycomb pattern material. The honeycomb pattern material may be, for example, Hexcel HRH10-3/8-1.5 honeycomb (which has a density of 1.5 lbs/ft$^3$, a dielectric constant of less than 1.05).

The polarizer section 102 includes polarizer plates 110 separated by spacer sections 112. The spacer sections 112 are preferably formed from a low dielectric constant, low density foam. For example, Emerson ECCO PS, 6-2-4 foam may be used to form the spacer sections 112. The polarizer plates 110 may be formed by depositing a conductive material, for example a precious metal, onto the spacer sections 112. Thus, the polarizer plates 110 may be extremely thin (for example, on the order of a few mils) thereby greatly reducing their contribution to the weight of the polarizer assembly 100.

The polarizer section 102 may include a covering 114 to stabilize the polarizer assembly if necessary. As an example, a layer of SpectraFiber Triax 10 mils thick may form the covering 114 for the polarizer section 102. The complete polarizer assembly 100 may then be installed on top of the slotted array panel 106 of the antenna. Transmitted beams then pass through the slotted array panel 106 and into the polarizer assembly 100.

The exact dimensions of the polarizer assembly 100 may vary to conform to the dimensions of the antenna and associated slotted array panel 106. As one example, however, the foundation section 104 may be approximately 2 inches thick, 79 inches wide, and 135 inches long. The polarizer plates 110 may be a few mils thick and 5 inches high and may be arranged in parallel at 45 degree angles across the foundation section. The spacer sections 112 may be approximately 3.8 inches wide and 5 inches high. The dimensions noted above are given only as a general indication of the scale of one embodiment of the polarizer assembly 100. Other dimensions may also be suitable for use in the polarizer assembly 100.

Figure 2:
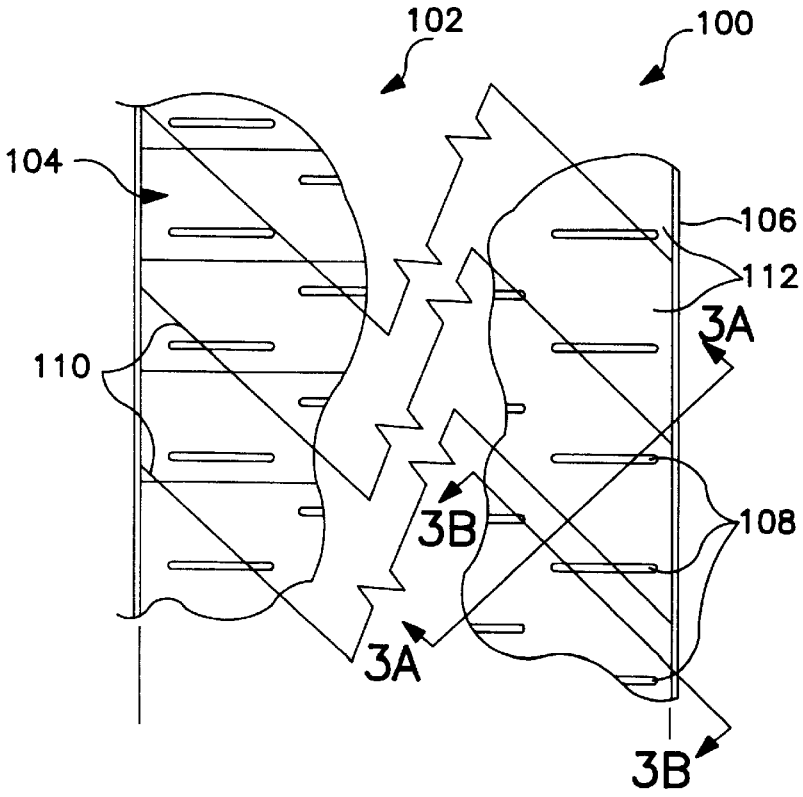
FIG. 2 shows a drawing of a polarizer assembly including a polarizer section and a foundation section.

Turning now to FIG. 2, that Figure shows a top down view of the polarizer assembly 100 including a polarizer section 102 and a foundation section 104. The polarizer assembly 100 in FIG. 2 is shown positioned on a slotted array panel 106. The slotted array panel 106 includes slots 108 through which transmitted beams pass into the polarizer assembly 102. The polarizer plates 110 (which may number 39 or more) are shown arranged at a 45 degree angle and separated by the spacer sections 112. Two sections of FIG. 2, A—A (a cut perpendicular to the polarizer plates 112) and B—B (a cut parallel to the polarizer plates 112) are illustrated in FIG. 3.

Figure 3A:
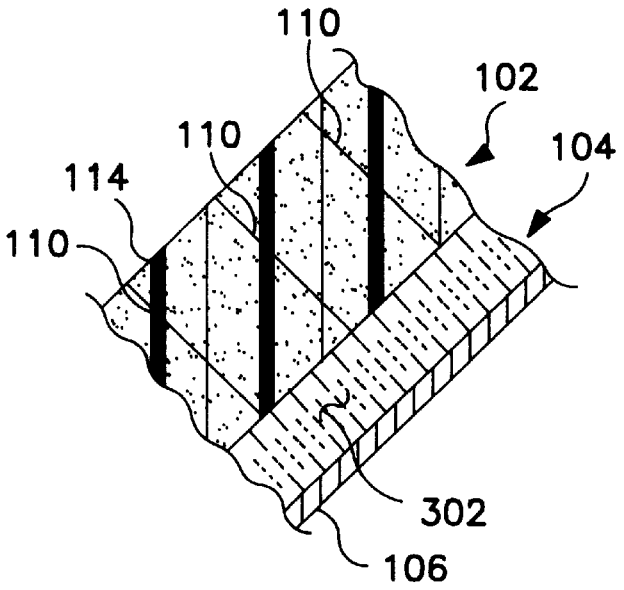
FIG. 3 shows two cross sectional views of the polarizer assembly of FIG. 2.
Figure 3B:
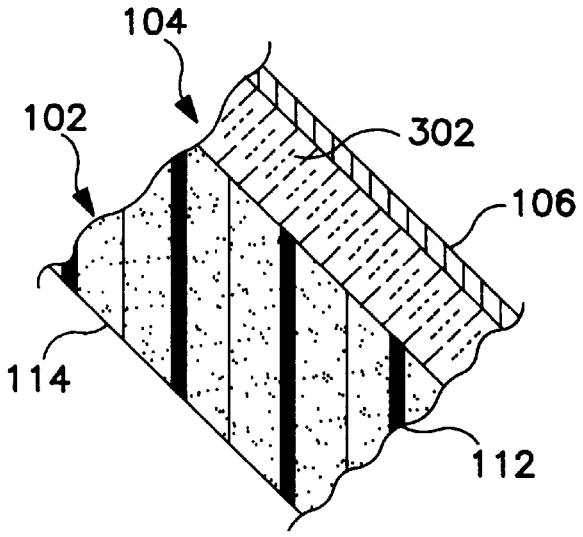

Section A—A in FIG. 3 illustrates the polarizer section 102, foundation section 104 and slotted array panel 106. As noted above, the foundation section 104 may include a honeycomb pattern 302. The polarizer plates 110 are shown supported by the foundation section 104 and separated by the spacer sections 112. A cover sheet 114 is also illustrated on top of the polarizer section 102. The cover sheet 114 is preferably formed from a dielectric fiber, for example, SpectraFiber Triax.

Section B—B in FIG. 3 again illustrates the polarizer section 102, foundation section 104 and slotted array panel 106. The foundation section 104 is shown including a honeycomb pattern 302. No polarizer plates 110 are visible in section B—B, however, the polarizer section 102 (including the spacer sections 112) is shown supported by the foundation section 104. A cover sheet 114 is also illustrated on top of the polarizer section 102.

Turning now to FIG. 4, an alternate embodiment of a light weight parallel plate polarizer is shown. FIG. 4 illustrates the top view of a suspension design for a parallel plate polarizer assembly 400. The parallel plate assembly 400 includes polarizer plates 402 suspended on dielectric meshes 602 (FIG. 6) between first support member 404 and second support member 406.

The first support members 404 may secure one end of the dielectric meshes 602 and the polarizer plates 402, for example, with two upper and lower cable end fittings 408. The second support members 406 may secure one end of the dielectric meshes 602 and the polarizer plates 402, for example, with upper and lower compression springs 410. The compression spring 410 may then be used to adjust the cable tension 504 across the dielectric meshes 602. The first support members 404 may be separate structural elements (for example, vertical brackets), or may be an integral part of a first support wall. Similarly, the second support members 406 may be separate structural elements or may be an integral part of a second support wall.

The suspension design of the parallel plate assembly 400 suspends the polarizer plates 402 above the slotted array panel 416. The polarizer plates 402 may be suspended, for example, 2 inches above the slotted array panel 416. As noted above, the slotted array panel 412 includes openings 418 through which the transmitted beam passes into the polarizer assembly 400.

Turning now to FIG. 5, one means for securing the polarizer plates 402 to the dielectric meshes 602 is shown. FIG. 5 shows a section A—A taken from FIG. 4 that illustrates an eye-loop section 502 formed in the dielectric mesh 602. A cable 504 is threaded through the eye-loop 502. The cable 504 may be secured by the first support member 404 and the second support member 406 via 408 and 410 respectively. The cable 504 may be implemented, for example, as a wire, fiber strand, or the like. Other methods of attaching the polarizer plates 402 to the dielectric meshes 602 are also suitable. As an example, the polarizer plates 402 may be bonded to the dielectric meshes 602.

In one embodiment of the polarizer assembly 400, the polarizer plates 402 are formed from a Polymide base (for example, Polymide sold under the trademark name Kapton) on which is deposited a conductive coating (for example, a precious metal).

Turning now to FIG. 6, that Figure shows an end view of the polarizer assembly 400. In FIG. 6, the dielectric meshes 602 are shown supporting the polarizer plates 402 between the first support posts 404 and the second support posts 406. A polarizer plate 402 may be attached on one or both sides of the dielectric meshes 602. As shown in FIG. 4 the dielectric meshes 602 (and therefore the polarizer plates 402) may be aligned at a 45 degree angle and in parallel with respect to one another.

As noted above, the first support member 404 may include a pin cable end fitting 408 and the second support member 406 may include a compression spring 410. In general, the tension produced by the dielectric meshes 602 generates a force which pulls inward on the first support member 404 and the second support member 406. As a result, additional structural reinforcement (not shown) may be included to brace the first support member 404 and second support member 406. As an example, a structural support member may be placed between the bases of the first support member 404 and the second support member 406. High tension cables may then run between the first support member 404 and the second support member 406 below the structural support member. The high tension cables may then help offset the inward pulling force generated by the dielectric meshes 602.

Turning now to FIG. 7, that Figure illustrates a side view of the polarizer assembly 400. FIG. 7 shows another view of the polarizer plates 402 supported by the dielectric meshes 602. FIG. 7 also shows two first support members 704 and 706 and a single second support member 708. As described above, the dielectric meshes 602 are suspended between first support members and the second support member. Note, however, that as shown in FIG. 7, the first support members 704 and 706 and the second support member 708 do not support the same dielectric meshes 602. Rather, FIG. 7 shows three dielectric meshes 602 crossing in front of each other.

While particular elements, embodiments and applications of the present invention have been shown and described, it will be understood that the invention is not limited thereto since modifications may be made by those skilled in the art, particularly in light of the foregoing instruction. It is therefore contemplated by the appended claims to cover such modifications as incorporate those features which come within the spirit and scope of the invention.

What is claimed is:

1. A light weight parallel plate polarizer comprising:

a polarizer section comprising dielectric spacer sections alternating with individual polarizer plates; and a foundation section supporting said polarizer section, said foundation section comprising a dielectric material.

2. The light weight parallel plate polarizer of claim 1, wherein said foundation section further comprises a honeycomb pattern material.

3. The light weight parallel plate polarizer of claim 2, wherein said polarizer plates comprise conductive coating deposited on said spacer sections.

4. The light weight parallel plate polarizer of claim 3, further comprising a dielectric cover sheet on top of said polarizer section.

5. The light weight parallel plate polarizer of claim 4, wherein said dielectric cover sheet is a dielectric fiber cover sheet.

6. The light weight parallel plate polarizer of claim 1, wherein said polarizer plates comprise conductive coating deposited on said spacer sections.

7. The light weight parallel plate polarizer of claim 1, further comprising a dielectric cover sheet on top of said polarizer section.

8. The light weight parallel plate polarizer of claim 7, wherein said dielectric cover sheet is a dielectric fiber cover sheet.

9. The light weight parallel plate polarizer of claim 1, wherein said polarizer plates are arranged at an approximately 45 degree angle across said foundation section.

10. The light weight parallel plate polarizer of claim 1, wherein a height of said polarizer plates is approximately equal to a spacer section height.

11. A light weight parallel plate polarizer comprising:

a plurality of first support members;

a plurality of second support members;

a plurality of separate dielectric meshes, each dielectric mesh suspended between a first support member and a second support member; and a plurality of polarizer plates attached to said plurality of dielectric meshes.

12. The light weight parallel plate polarizer of claim 11, wherein each of said plurality of polarizer plates comprises a conductive layer deposited on a support layer.

13. The light weight parallel plate polarizer of claim 12, wherein said support layer is a Polymide base.

14. The light weight parallel plate polarizer of claim 11, further comprising at least one compression spring attached to at least one of said second support members.

15. The light weight parallel plate polarizer of claim 14, wherein said first support members are vertically extending posts.

16. The light weight parallel plate polarizer of claim 15, wherein said second support members are vertically extending posts.

17. The light weight parallel plate polarizer of claim 11 wherein said polarizer plates are attached by bonding.

18. The light weight parallel plate polarizer of claim 12 wherein said polarizer plates are attached by cables between said first and second support members.

19. The light weight parallel plate polarizer of claim 11, wherein at least one of said dielectric meshes includes polarizer plates attached on both sides of said at least one dielectric mesh.

20. The light weight parallel plate polarizer of claim 11, wherein said dielectric meshes suspend said polarizer plates at an approximately 45 degree angle.

* * * * *